US011136876B1

(12) United States Patent
Coley

(10) Patent No.: US 11,136,876 B1
(45) Date of Patent: Oct. 5, 2021

(54) SYSTEM AND METHOD FOR DRILLING RIG STATE DETERMINATION

(71) Applicant: BP Corporation North America Inc., Houston, TX (US)

(72) Inventor: Christopher J. Coley, London (GB)

(73) Assignee: BP CORPORATION NORTH AMERICA INC., Houston, TX (US)

( * ) Notice: Subject to any disclaimer, the term of this patent is extended or adjusted under 35 U.S.C. 154(b) by 489 days.

(21) Appl. No.: 16/327,385

(22) PCT Filed: Aug. 15, 2017

(86) PCT No.: PCT/US2017/046864
§ 371 (c)(1),
(2) Date: Feb. 22, 2019

(87) PCT Pub. No.: WO2018/038963
PCT Pub. Date: Mar. 1, 2018

Related U.S. Application Data

(60) Provisional application No. 62/378,398, filed on Aug. 23, 2016.

(51) Int. Cl.
*E21B 44/00* (2006.01)

(52) U.S. Cl.
CPC ..... *E21B 44/00* (2013.01)

(58) Field of Classification Search
CPC ..... E21B 44/00
See application file for complete search history.

(56) References Cited

U.S. PATENT DOCUMENTS 4,616,321 A 10/1986 Chan
6,892,812 B2 * 5/2005 Niedermayr ..... E21B 44/00 166/250.15
7,128,167 B2 * 10/2006 Dunlop ..... G06N 7/005 175/24
9,567,843 B2 * 2/2017 Saeed ..... E21B 21/08
(Continued)

FOREIGN PATENT DOCUMENTS

WO 03/089758 A1 10/2003
WO 2004/048249 A1 6/2004
WO WO-2021034347 A1 * 2/2021 ..... E21B 41/00

OTHER PUBLICATIONS

PCT/US2017/046864 International Search Report and Written Opinion dated Nov. 6, 2017 (500880) (11 p.).
(Continued)

*Primary Examiner* — Jennifer H Gay
(74) *Attorney, Agent, or Firm* — Conley Rose, P.C.

(57) ABSTRACT

A method for drilling a borehole in a subsurface formation includes receiving measured values indicative of operations performed by drilling equipment while drilling. The measured values include hookload values. The hookload values are analyzed to identify hookload values acquired while connecting a drill pipe, and a block weight value is set based on such a hookload value. The block weight value is subtracted from the hookload values to produce rebased hookload values. A rig state model produces a value for a state of the drilling equipment based on the measured values and the rebased hookload values. Responsive to the state of the drilling equipment, an operation performed to drill the subsurface formation is changed.

14 Claims, 6 Drawing Sheets

(56) References Cited

U.S. PATENT DOCUMENTS

| | | | | |
|---|---|---|---|---|
| 9,792,571 | B1 * | 10/2017 | Mandava | G06Q 10/06393 |
| 10,066,473 | B2 * | 9/2018 | Khare | G05B 23/0208 |
| 10,473,816 | B2 * | 11/2019 | Belaskie | E21B 47/06 |
| 2003/0220742 | A1 * | 11/2003 | Niedermayr | E21B 44/00 702/9 |
| 2004/0124009 | A1 * | 7/2004 | Hoteit | G06N 7/005 175/25 |
| 2004/0124012 | A1 * | 7/2004 | Dunlop | E21B 44/00 175/57 |
| 2009/0164125 | A1 | 6/2009 | Bordakov et al. | |
| 2011/0024189 | A1 * | 2/2011 | Saeed | E21B 44/00 175/40 |
| 2012/0059521 | A1 * | 3/2012 | Iversen | E21B 44/00 700/275 |
| 2015/0090498 | A1 | 4/2015 | Hareland | |
| 2015/0362621 | A1 * | 12/2015 | Belaskie | E21B 47/06 702/6 |
| 2017/0145809 | A1 * | 5/2017 | Spoerker | E21B 44/00 |
| 2018/0003024 | A1 * | 1/2018 | Khare | E21B 47/007 |
| 2018/0266233 | A1 * | 9/2018 | Ahmed | E21B 47/047 |
| 2019/0063192 | A1 * | 2/2019 | Lhommet | E21B 47/00 |
| 2020/0355063 | A1 * | 11/2020 | Van Vliet | E21B 47/07 |

OTHER PUBLICATIONS

Cayeux, Eric, et al., "Accuracy and Correction of Hook Load Measurements During Drilling Operations," Mar. 19, 2015, SPE/IADC Drilling Conference and Exhibition, London, England, UK (SPE/IADC 173035) (38 p.).

* cited by examiner

SYSTEM AND METHOD FOR DRILLING RIG STATE DETERMINATION

CROSS-REFERENCE TO RELATED APPLICATIONS

This application is a 35 U.S.C. § 371 national stage application of PCT/US2017/046864 filed Aug. 15, 2017 and entitled "System and Method for Drilling Rig State Determination," which claims priority to U.S. Application No. 62/378,398 filed Aug. 23, 2016 and entitled "System and Method for Drilling Rig State Determination," both of which are hereby incorporated herein by reference in their entirety for all purposes.

STATEMENT REGARDING FEDERALLY SPONSORED RESEARCH OR DEVELOPMENT

Not applicable.

BACKGROUND

A large portion of the cost involved in the exploration for and production of oil and gas results directly from the expense of drilling wells. Drilling costs have increased substantially in recent years, considering that many of the easily discovered and accessible fields in the world are already producing. Consequently, new wells to reach less-accessible reservoirs are generally much deeper, and otherwise much more complex, than previously drilled wells. New wells are also often drilled at locations of reduced confidence with regard to the presence of a potential producing potential reservoir, because of the extreme depth of the remaining reservoirs. Even when drilling into more certain hydrocarbon reservoirs, drilling costs are also often higher than in the past because of the inaccessibility of the reservoirs (e.g., at locations far offshore), or other local difficulties.

Because of these increasing costs involved in modern drilling, it is important that the drilling operation be carried out accurately and efficiently. Accurate drilling is also especially important as smaller potential reservoirs, at greater depths into the earth, are being exploited. The extreme depths to which modern wells are being drilled add many complications to the drilling process, including the cost and effort required to address drilling problems that may occur at such extreme depths and with the attendant increased well complexity. Identification of problems and issues in drilling are frequently dependent on accurate determination of the state of the drilling rig.

BRIEF DESCRIPTION OF THE DRAWINGS

For a detailed description of exemplary embodiments, reference will now be made to the accompanying drawings, in which.

NOTATION AND NOMENCLATURE

In the following discussion and in the claims, the terms "including" and "comprising" are used in an open-ended fashion, and thus should be interpreted to mean "including, but not limited to . . . ". The term "couple" is not meant to limit the interaction between elements to direct interaction between the elements and may also include indirect interaction between the elements described. The term "software" includes any executable code capable of running on a processor, regardless of the media used to store the software. Thus, code stored in memory (e.g., non-volatile memory), and sometimes referred to as "embedded firmware," is included within the definition of software. The recitation "based on" is intended to mean "based at least in part on." Therefore, if X is based on Y, X may be based on Y and any number of additional factors. The term "or" is used inclusively. Accordingly, the term "or" is equivalent to the term "and/or."

DETAILED DESCRIPTION

In conventional drilling systems, rig state (e.g., the particular operation being performed by the rig at a given time) may be manually determined by rig personnel. Unfortunately, because states change quickly and downhole operations are obscured from view, manual rig state determination may be subject to error. Because drilling operations may be selected and performed based on rig state, inaccuracies in rig state determination may hamper drilling efficiency. For example, if a determined rig state is in error, then a change in drilling operations, that would have been made had the rig state been accurately determined, may not be made, resulting in reduced drilling efficiency.

Embodiments of the drilling system and method disclosed herein apply a rig state determination technique that provides improved accuracy of rig state detection versus conventional techniques. Embodiments of the present disclosure receive measurements produced by rig sensors, such as downhole sensors and sensors disposed in surface equipment of the rig, etc. Such measurements may include values for bit depth, hole depth, flow rate of drilling fluid, rate of drill string rotation, hookload, or other measured values acquired while drilling a wellbore. The sensor measurements are preprocessed for application to a rig state model. The rig state model generates a rig state value based on the preprocessed sensor measurements. Post-processing is applied to the generated rig state model to adjust the state as needed based on rig states preceding or succeeding the generated rig state. The preprocessing applied to the sensor measurements may include generating additional values for use in rig state model, and adjusting hookload measurements to exclude block weight. Embodiments may apply a block weight model to determine block weight by evaluating the probability that each hookload measurement represents block weight. The rig state model or the block weight model may be implemented as a RANDOM FOREST.

Figure 1:
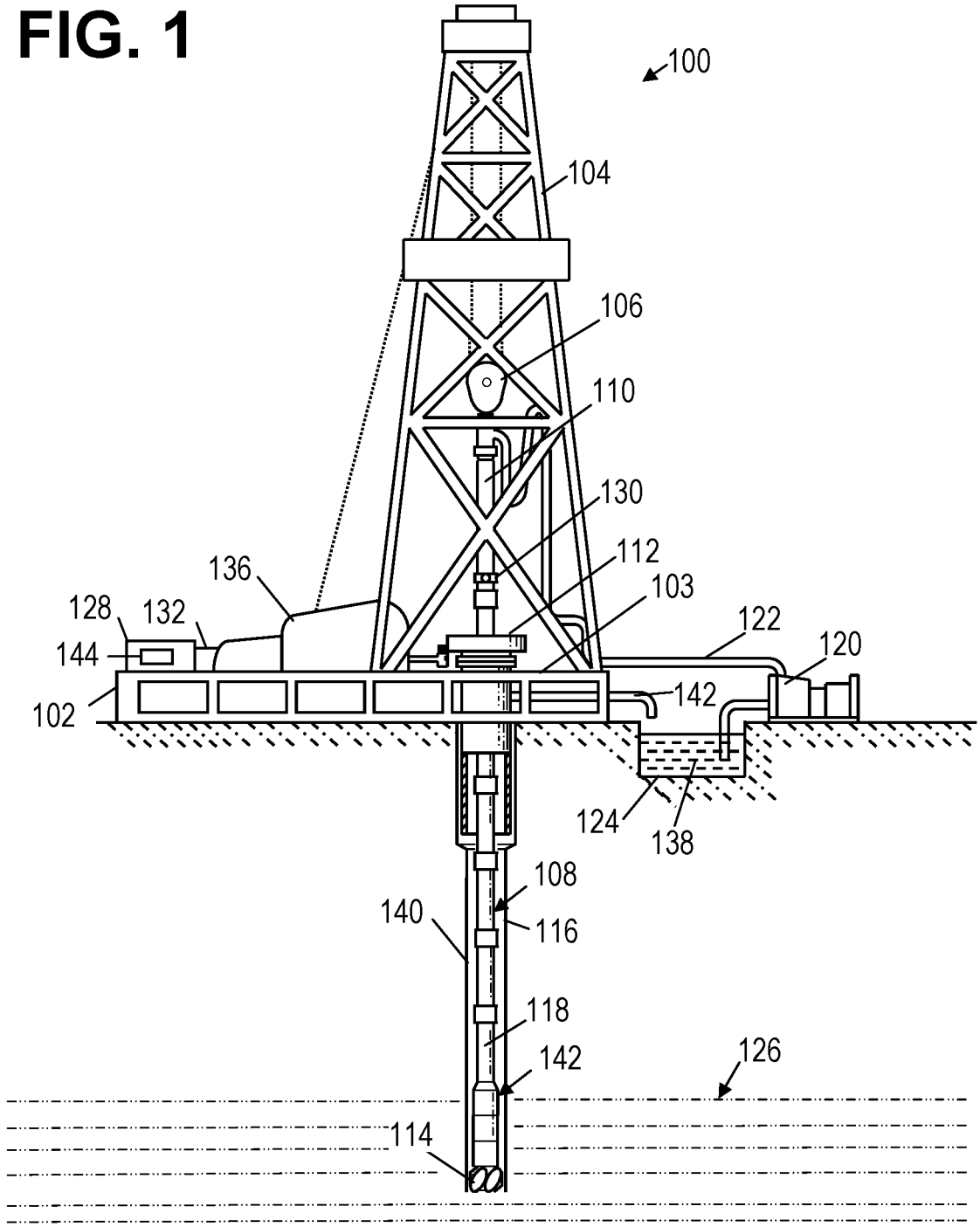
FIG. 1 shows a system for drilling a borehole that includes rig state determination in accordance principles disclosed herein.

FIG. 1 shows a system 100 for drilling a borehole that includes rig state determination in accordance principles disclosed herein. The system 100 may be referred to as a drilling rig. The drilling system 100 includes a derrick 104 supported by a drilling platform 102. The derrick 104 includes a floor 103 and a traveling block 106 for raising and lowering a drill string 108. The derrick may support a rotary table 112 that is rotated by a prime mover such as an electric motor controlled by a motor controller. A kelly 110 supports the drill string 108 as it is lowered through the rotary table 112. In some embodiments, a top drive may be used to rotate the drill string 108 in lieu of the rotary table 112 and kelly 110.

The drill string 108 extends downward through the rotary table 112, and is made up of various components, including drill pipe 118 and components of the bottom hole assembly (BHA) 142 (e.g., bit 114, mud motor, drill collar, tools, etc.). The drill bit 114 is attached to the lower end of the drill string 108. The drill bit 114 disintegrates the subsurface formations 126 when it is rotated with weight-on-bit to drill the borehole 116. The weight-on-bit, which impacts the rate of penetration of the bit 114 through the formations 126, is controlled by a drawworks 136. In some applications, a downhole motor (mud motor) is disposed in the drilling string 108 to rotate the drill bit 114 in lieu of or in addition to rotating the drill string 108 from the surface. The mud motor rotates the drill bit 114 when drilling fluid passes through the mud motor under pressure.

As indicated above, during drilling operations a suitable drilling fluid 138 from a mud tank 124 is circulated under pressure through the drill string 108 by a mud pump 120. The drilling fluid 138 passes from the mud pump 120 into the drill string 108 via fluid line 122 and the kelly 110. The drilling fluid 138 is discharged at the borehole bottom through nozzles in the drill bit 114. The drilling fluid 138 circulates to the surface through the annular space 140 between the drill string 108 and the sidewall of borehole 116, and returns to the mud tank 124 via a solids control system (not shown) and a return line 142. The drilling fluid 138 transports cuttings from the borehole 116 into the reservoir 124 and aids in maintaining borehole integrity. The solids control system separates the cuttings from the drilling fluid 138, and may include shale shakers, centrifuges, and automated chemical additive systems. The density of the drilling fluid 138 may be adjusted based on the pore pressure of the formations 126.

Various sensors are employed in the drilling system 100 to monitor a variety of surface-controlled drilling parameters and downhole conditions. For example, a sensor disposed in the fluid line 122 measures and provides information about the drilling fluid flow rate and pressure. A surface torque sensor and a rotational speed sensor associated with the drill string 108 measure and provide information about the torque applied to the drill string 108 and the rotational speed of the drill string 108, respectively. Additionally, a sensor associated with the traveling block 106 may be used to measure and provide hookload measurements. Hookload refers to the weight of the load supported by the drawworks 136, including the weight of the traveling block 106 and any components supported by the traveling block 106 (e.g., the drill string 108). Additional sensors are associated with the motor drive system to monitor proper drive system operation. These include, but are not limited to, sensors for detecting such parameters as motor speed (RPM), winding voltage, winding resistance, motor current, and motor temperature. Other sensors are used to indicate operation and control of the various solids control equipment.

The BHA 142 may also include a measurement-while-drilling or a logging-while-drilling assembly containing sensors for measuring drilling dynamics, drilling direction, formation parameters, downhole conditions, etc. Outputs of the sensors may be transmitted to the surface using any suitable downhole telemetry technology known in the art (e.g., wired drill pipe, mud pulse, electromagnetic, drill string acoustic, etc.).

The drilling system 100 includes a drilling control system 128 that controls drilling operations, such as rotation rate of the drill string 108, torque applied to the drill string 108, raising and lowering of the drill string 108, weight-on-bit, density, pressure, or flow rate of the drilling fluid, etc. Outputs from the various sensors are provided to the drilling control system 128 via a connection 132 that may be wired or wireless. For example, the drilling control system 128 may control the drawworks 138, a prime mover, a top drive, the mud pump 120, etc. responsive to sensor measurements received via the connection 132. In various embodiments, the drilling controlling control system 128 may be located proximate the drilling rig or may be remote from the drilling rig.

The drilling control system 128 processes the sensor outputs to evaluate and control the drilling process. The drilling control system 128 includes a rig state monitor 144. The rig state monitor 144 analyzes and processes measurements received by the various sensors of the system 100 to determine the state of the rig at any given time. Rig states identified by the rig state detector may include washing up, washing down, backreaming with flow, backreaming without flow, reaming down with flow, reaming down without flow, circulating, circulating and rotating, static, rotating off bottom, rotary drilling, slide drilling, connection, trip in, and trip out. These rig states may be specified as:

| State | Pumping? | Rotating? | Movement Direction | On Bottom? |
|---|---|---|---|---|
| washing up | Yes | No | Up | No |
| washing down | Yes | No | Down | No |
| backreaming with flow | Yes | Yes | Up | No |
| backreaming without flow | No | Yes | Up | No |
| reaming down with flow | Yes | Yes | Down | No |
| reaming down without flow | No | Yes | Down | No |
| circulating | Yes | No | Stationary | No |
| circulating and rotating | Yes | Yes | Stationary | No |
| static | No | No | Stationary | No |
| rotating off bottom | No | Yes | Stationary | No |
| rotary drilling | Yes | Yes | Down | Yes |
| slide drilling | Yes | No | Down | Yes |
| connection | | | | No |
| trip in | No | No | Down | No |
| trip out | No | No | Up | No |

The drilling control system 128 applies the rig states and information associated with transitions between rig states to control drilling operations. For example, if the rig state monitor 144 determines that the rig is in a first state, and the drilling control system 128 determines that according to a drilling plan or other drilling control information, the rig should be in a different state, then the drilling control system 128 may change various parameters of the drilling system 100 to transition the rig to a desired state. Similarly, by measuring the time the drilling system 100 is in a particular state, the drilling control system 128 may determine that drilling efficiency can be improved by reducing the time spent in that state, and may change various parameters of the drilling system 100 to reduce the time spent in the state. If the rig states cannot be accurately determined, then the drilling control system 128 may be unable to control drilling operations in a way that improves efficiency, or may make undesirable changes to drilling operations.

While the drilling system 100 has been illustrated as land based, various embodiments of the drilling system 100 may be employed to perform marine drilling. In such embodiments, the drill string 108 may extend from a surface platform through a riser assembly, a subsea blowout preventer, and a subsea wellhead into the subsea formations.

Figure 2:
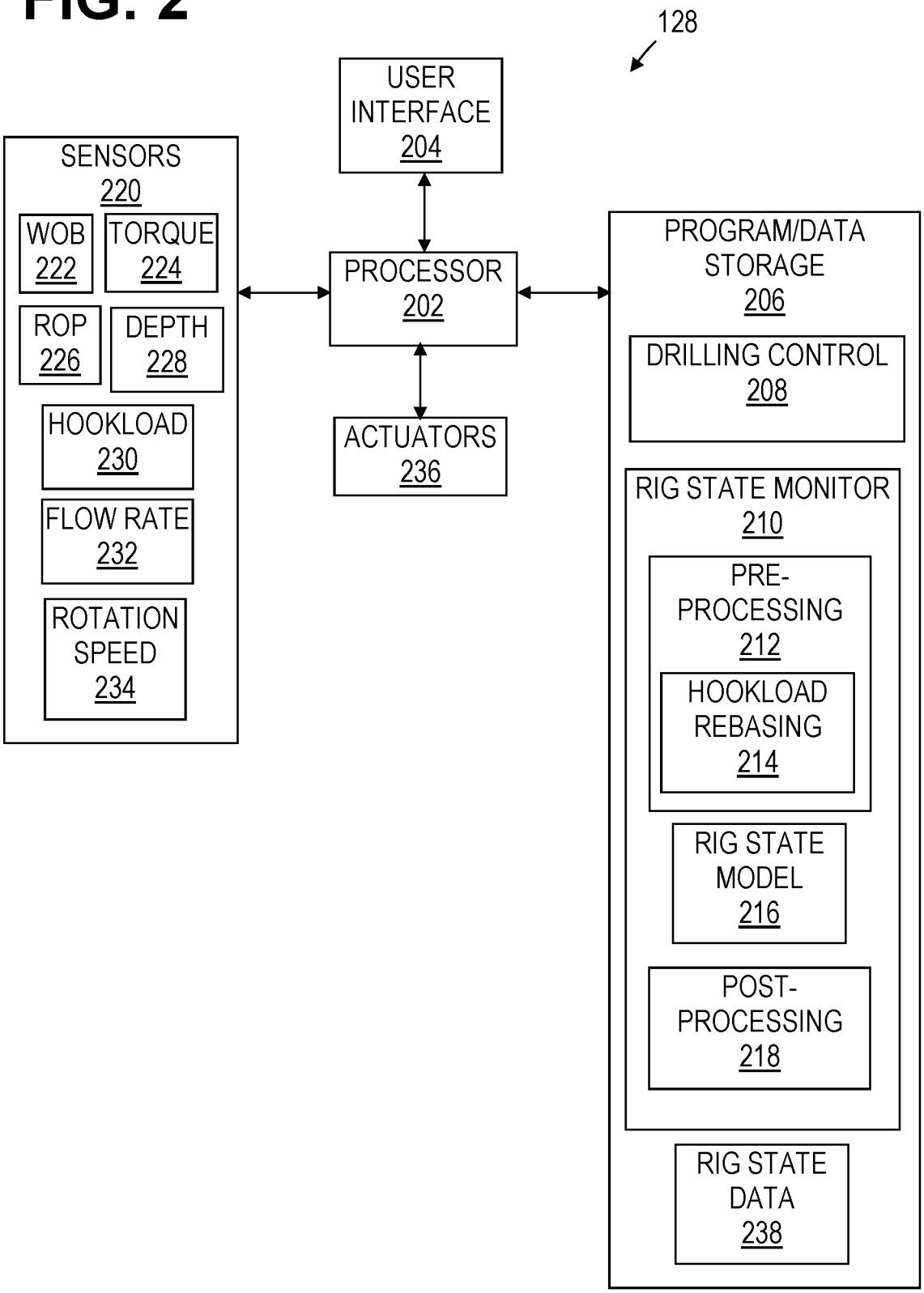
FIG. 2 shows a block diagram of a drilling control system that includes rig state determination in accordance with principles disclosed herein.

FIG. 2 shows a block diagram for the drilling control system 128. The drilling control system 128 includes a processor 202, a user interface 204, and program/data storage 206. The processor 202 is also coupled to the various sensors 220 and actuators 236 of the drilling system 100. In some embodiments of the drilling control system 128, the processor 202 and program/data storage 206 may be embodied in a computer, such as a desktop computer, notebook computer, a blade computer, a server computer, or other suitable computing device known in the art. The processor 202 is configured to execute instructions retrieved from storage 206. The processor 202 may include any number of cores or sub-processors. Suitable processors include, for example, general-purpose processors, digital signal processors, and microcontrollers. Processor architectures generally include execution units (e.g., fixed point, floating point, integer, etc.), storage (e.g., registers, memory, etc.), instruction decoding, peripherals (e.g., interrupt controllers, timers, direct memory access controllers, etc.), input/output systems (e.g., serial ports, parallel ports, etc.) and various other components and sub-systems.

The actuators 236 include mechanisms or interfaces that are controlled by the processor 202 to affect drilling operations. For example, the processor 202 may control rotation speed of the drill string 108 by controlling an electric motor through a motor controller, or may similarly control weight-on-bit, raising, or lowering of the drill string 108 by controlling a motor in the drawworks 136. Various other types of actuators controlled by the processor 202 include solenoids, telemetry transmitters, valves, pumps, etc.

The user interface 204 includes one or more display devices used to convey information to a drilling operator or other user. The display may be implemented using one or more display technologies known in that art, such as liquid crystal, cathode ray, plasma, organic light emitting diode, vacuum fluorescent, electroluminescent, electronic paper, or other display technology suitable for providing information to a user. The user interface 204 may also include one or more data entry devices that can be manipulated by a user to control operations performed by or enter data into the drilling control system 128. Suitable data entry devices include a keyboard, a mouse, a trackball, a camera, a touchscreen, a touchpad, a voice recognition system, etc.

The sensors 220 are coupled to the processor 202, and, as discussed above, include sensors for measuring various drilling system operational parameters used by the processor 202 to determine rig state. Force sensors (e.g., a hydraulic load cell, strain gauges, etc.) coupled to the crown block or elsewhere in the drawworks measure the hookload 230 and the portion of the weight of the drill string 108 applied to the drill bit 114 (i.e., WOB 222). Torque sensors (e.g., strain gauges) coupled to the drill string 108 (e.g., downhole or at the surface) measure the torque 224 applied to the drill string 108. Rate of penetration sensors 226 detect motion of the traveling block 106 or extension of the line supporting the traveling block 106, or other indications of the drill string 108 descending into the borehole 116. Speed sensors 234 (e.g., angular position sensors) disposed downhole or at the surface detect rotational speed of the drill string 108. Depth 228 may include hole depth (i.e., the length of the borehole 116) or bit depth (i.e., the length of the drill string 108 in the borehole 116) measured as function of a maximum or current length of the drill string 108 in the borehole 116.

Software programming, including instructions executable by the processor 202, is stored in the program/data storage 206. The program/data storage 206 is a non-transitory computer-readable medium. Computer-readable storage media include volatile storage such as random access memory, non-volatile storage (e.g., ROM, PROM, a hard drive, an optical storage device (e.g., CD or DVD), FLASH storage), or combinations thereof.

The program/data storage 206 includes a drilling control module 208 and a rig state monitoring module 210. The drilling control module 208, when executed, causes the processor 202 to control drilling operations. At least some of the control operations performed by the drilling control module 208 are based on the rig state information provided by the rig state monitoring module 210. The drilling control module 208 and the rig state monitoring module 210 include instructions that are executable by the processor 202 to perform the rig control and rig state determination functions disclosed herein.

The rig state monitoring module 210 receives measurements generated by the sensors 220, and processes the measurements to determine what state the drilling system 100 is in at any given time. The rig state monitoring module 210 includes a pre-processing module 212, a rig state model 216, and a post-processing module 218. The pre-processing module 212 processes the measurements received from the sensors 220 as needed for use as input to the rig state model 216. The pre-processing module 212 includes a hookload rebasing module 214 that processing the hookload measurements to identify a block weight value, and subtracts the block weight value from the hookload measurements to produce rebased hookload measurements. Identification of the block weight value may include application of the hookload measurements to a block weight model (included in the hookload rebasing module 214) that determines the probability that each hookload measurement was made while making a connection. The block weight model may include a RANDOM FOREST trained to assess the probability that a hookload measurement was made during a connection.

The rig state model 216 generates an initial rig state value based on the preprocessed sensor measurements. The rig state model 216 may include a RANDOM FOREST trained to identify rig state based on the pre-processed sensor measurements. The post-processing is applied to the initial rig state value to adjust the state as needed based on rig states preceding or succeeding the generated rig state or other measurements of the sensors 220 that may indicate the initial rig state identified by the rig state model 216 may not be the most appropriate rig state.

In some embodiments, the rig state monitor 144, as implemented by a computing device executing the rig state monitoring module 210 may be implemented on a different machine or at a different location from the computing device that executes the drilling control module 208. In such embodiments, communication between the rig state monitor 144 and the computing device that executes the drilling control module 208 may be provided via a wired or wireless network as known in the art. In some embodiments, connection of the rig state monitor 144 to the computing device the executes the drilling control module 208 via a communication network, such as wired or wireless network facilitates efficient communication of rig state information, and in turn facilitates efficient rig control.

Figure 3:
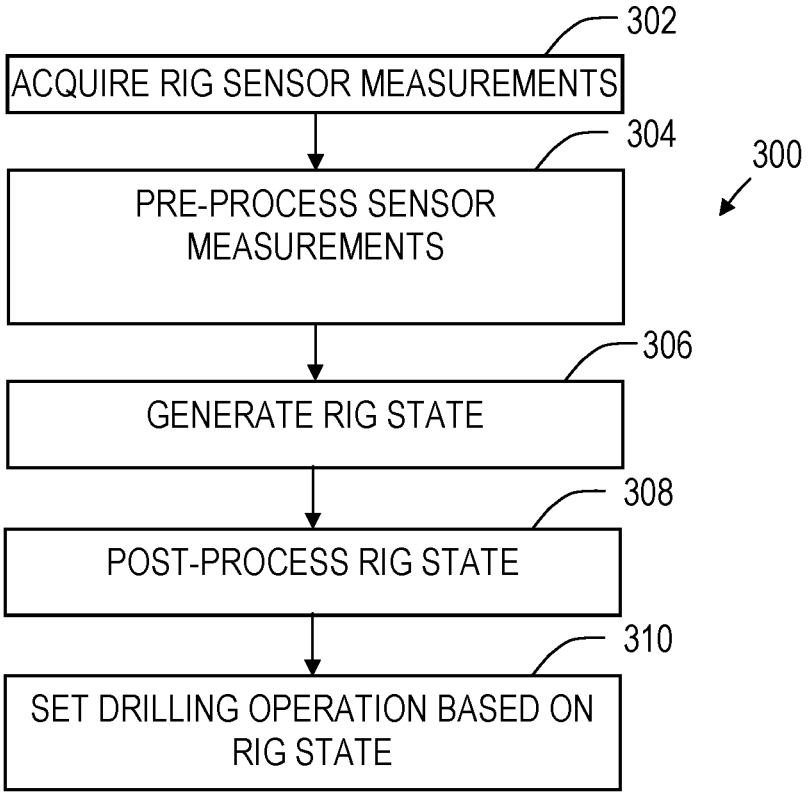
FIG. 3 shows a flow diagram for a method for determining rig state and controlling rig operation in accordance with principles disclosed herein.

FIG. 3 shows a flow diagram for a method 300 for determining rig state and controlling rig operation in accordance with principles disclosed herein. Though depicted sequentially as a matter of convenience, at least some of the actions shown can be performed in a different order or performed in parallel. Additionally, some embodiments may perform only some of the actions shown. In some embodiments, at least some of the operations of the method 300, as well as other operations described herein, can be implemented by the drilling control system 128 via execution of instructions of the rig state monitoring module 210 by the processor 202.

In block 302, the drilling control system 128 acquires measurements from the various sensors of the drilling system 100. For example, the drilling control system 128 may acquire measurements of torque, drill string rotation speed, rate of penetration, rate of drilling fluid flow, hookload, measured hole depth, measured bit depth, or other parameters associated with operation of the drilling system 100 while drilling the borehole 116. The sensor measurements may be stored in the program/data storage 206 for processing by the rig state monitoring module 210.

In block 304, the rig state monitoring module 210 initiates processing of the sensor measurements acquired in block 302 to produce a determination of rig state. Processing begins with execution of the pre-processing module 212. The pre-processing module 212 derives from the sensor measurements a number of additional input values that are used by the rig state model 216 to determine rig state. Additional details of the operations of sensor measurement pre-processing are provided in FIG. 4 and associated text.

In block 306, the sensor measurements acquired in block 302 and the additional input values derived from the sensor measurements in block 304 are provided to and processed by the rig state model 216. In some embodiments, the sensor measurements and additional input values processed by the rig state model include: standpipe pressure, weight on bit, torque, rate of penetration, hole depth-bit depth, values of lagged hole depth-bit depth, hookload, rebased hookload; binary flow, and binary rotation.

A RANDOM FORESTS or random decision forest is a machine learning and data mining technique that applies an ensemble learning method for classification, regression and other tasks. RANDOM FORESTS operate by constructing a multitude of decision trees at training time and outputting the class that is the mode of the classes (classification) or mean prediction (regression) of the individual trees. The rig state model 216 may include a RANDOM FOREST comprising a plurality of randomized classification trees. In the rig state model 216, the inputs (sensor measurements and additional input values) are processed by each of the plurality of classification trees, and each tree classifies the inputs as indicating that the drilling system 100 is in a particular one of the rig states. The rig state model 216 selects as the rig state associated with the input values a rig state value produced by a highest number of the classification trees (i.e., the modal prediction). The rig state model 216 may also provide a confidence value for each rig state value. The confidence value may be, for example, the percentage of total number of classification trees that output the rig state value selected as the output of the rig state model 216. The rig state model 216 is able to detect rapid transitions in rig state that may go unnoticed by human operator, which can aid in identification of unaccounted for rig operating time.

The rig state model 216 is generated using training data (sensor measurements and additional input values) derived from any number of rigs. The training data is annotated by a person with knowledge of how the training data relates to rig state, and the training data is used to train the rig state model 216. Each of the classification trees may be trained using a different subset of the training data. While the classification capabilities of an individual tree may be limited, collectively the trees may provide a very accurate rig state classification. The rig state model 216 may include hundreds or thousands of classification trees.

In block 308, the rig state selected by the rig state model 216 is further processed by the post-processing module 218. The post-processing module 218 may process the rig state value provided by the rig state model 216 in conjunction with previously generated rig states or various sensor measurements to determine whether the rig state should be changed. Additional details of the operations of rig state post-processing are provided in FIG. 6 and associated text. The post-processed rig state may be stored in the rig state data 238 in sequence with previously generated rig states to form a record of the operating states of the drilling system 100 over time.

Some embodiments of rig state monitoring module 210 may also generate a variety of performance metrics and key performance indicators (KPIs) based on the sensor measurements, rig state determination, and other information. The metrics and KPIs may be applied to, for example, analyze rig performance. Various metrics and KPIs generated by the rig state monitoring module 210 may include tripping speed, connection analysis, state timing, crew performance, well-to-well comparisons, rig cost analysis, and other metrics and KPIs. The rig state monitoring module 210 may display rig state values, metrics, and KPIs on the user interface 204 for display by rig personnel.

In block 310, the drilling control system 128 sets or changes an operation performed by the drilling system 100 based on the rig state determined by the rig state monitoring module 210. For example, if the rig state information indicates that the drilling system 100 is spending more than a predetermined amount of time in a given rig state, then the drilling control system 128 may adjust an operation of the drilling system 100 to reduce the time spent in the given rig state. If the given rig state is connection, in which a pipe or pipe stand is connected to the drill string 108, then the drilling control system 128 change the operation of the drilling system 100 to reduce the time to perform some operation that performed as part of the connection state. In another example, if the rig state monitoring module 210 indicates that the drilling system 100 is in a particular rig state, but a drilling plan or other well design information indicates that the drilling system 100 should be in a different state, then drilling control system 128 can change the operation of the drilling system 100 to cause the drilling system 100 to transition to the appropriate rig state. In an additional example, the drilling control system 128 may automatically set parameters of the drilling system 100 based on the identified rig state. If the rig state is determined to be "slide drilling" or "rotary drilling," then the drilling control system may compare the current parameters (WOB, RPM, fluid pressure, etc.) of the drilling system 100 to ranges specified for parameters of the drilling system 100 while drilling, and change the parameter to be within the specified range.

Figure 4:
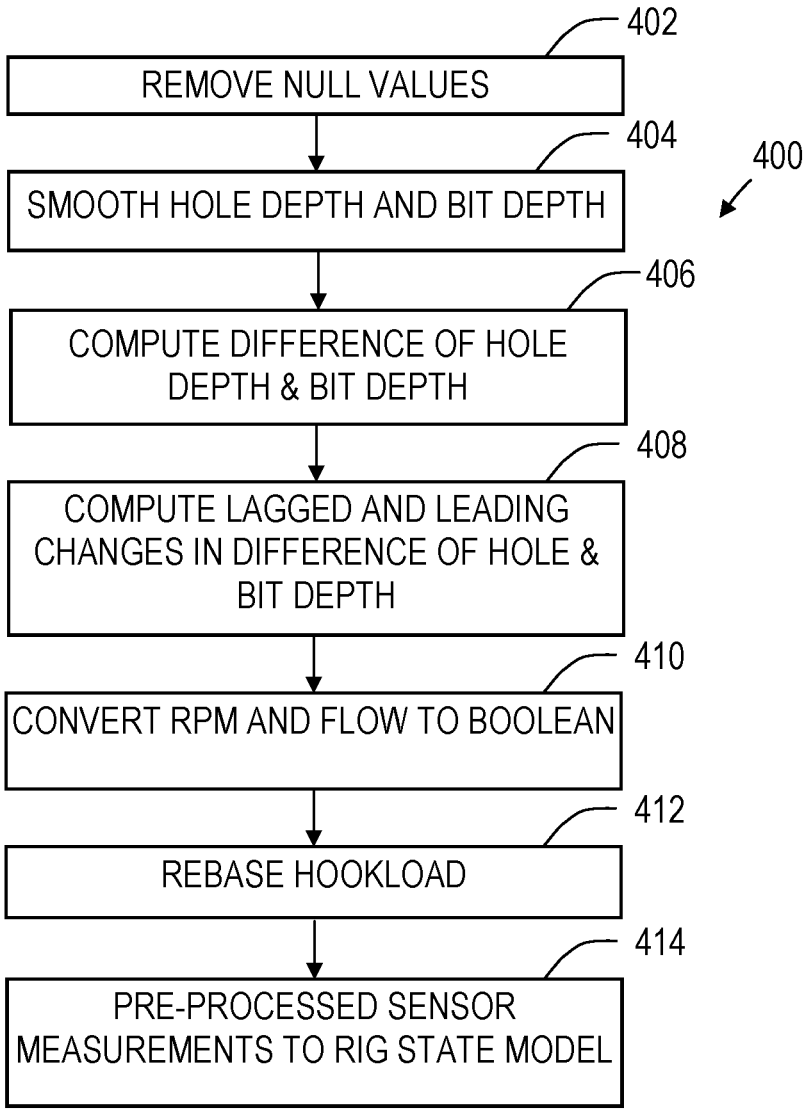
FIG. 4 shows a flow diagram for a method for preprocessing sensor measurements used in rig state classification in accordance with principles disclosed herein.

FIG. 4 shows a flow diagram for a method 400 for pre-processing sensor measurements used in rig state classification in accordance with principles disclosed herein.

Though depicted sequentially as a matter of convenience, at least some of the actions shown can be performed in a different order or performed in parallel. Additionally, some embodiments may perform only some of the actions shown. In some embodiments, at least some of the operations of the method 400, as well as other operations described herein, can be implemented by the drilling control system 128 via execution of instructions of the rig state monitoring module 210 by the processor 202. Operations of the method 400 may be performed as part of the operations of block 304 of FIG. 3.

In block 402, the pre-processing module 212 is processing a sequence of sensor measurements received from various sensors of the drilling system 100. Null or missing values in the sensor data may be replaced by values generated based on sensor measurements preceding or succeeding a missing value. For example, an interpolation (e.g., a linear interpolation) may be applied to the preceding and succeeding sensor measurements to produce a sensor measurement value to replace the missing value.

In block 404, smoothing is applied to the hole depth measurements and the bit depth measurements. The smoothing may include computing a moving average of the hole depth and a moving average of the bit depth.

In block 406, for each measurement of hole depth or bit depth, the pre-processing module calculates the difference of hole depth and bit depth.

In block 408, the pre-processing module 212 calculates changes in difference of hole depth and bit depth. The change values are referred to lagged or leading values. For example, given difference in hole depth and bit depth at times T, T−1, T−2, T−3, T−4, T−5, T−6, T+1, T+2, T+3, T+4, T+5, and T+6 calculated in block 406, the pre-processing module 212 may calculate lagged values as difference of the difference of hole and bit depth as T−(T−1), T−(T−2), T−(T−3), T−(T−4), T−(T−5), and T−(T−6), and calculate leading values as difference of the difference of hole and bit depth at T−(T+1), T−(T+2), T−(T+3), T−(T+4), T−(T+5), and T−(T+6) for depth data sampled at 0.2 hertz. Some embodiments may calculate a different number of lagged or leading values, or calculate the lagged and leading values using different time offsets between the difference values used in the calculations. For example, lagged or leading values may be calculated using difference in hole depth and bit depth at times T, T−6, T−11, T−16, T−21, T−26, T−31, T+6, T+11, T+16, T+21, T+26, and T+31 for depth values sampled at 1 hertz.

In block 410, the pre-processing module 212 converts drill string rotation and drilling fluid flow rate to Boolean values. The conversion may include generating Boolean values of flow and rotation in addition to the sensor measurements for flow and rotation. For example, if the measured rate of drill string rotation is greater than zero, then the pre-processing module 212 will set the Boolean rotation value to "1," otherwise the pre-processing module 212 will set the Boolean rotation value to "0." Similarly, if the measured rate of drilling fluid flow is greater than zero, then the pre-processing module 212 will set the Boolean flow value to "1," otherwise the pre-processing module 212 will set the Boolean flow value to "0."

In block 412, the pre-processing module 212 rebases the hookload measurements by removing block weight from each hookload measurement. Additional details of the hookload rebasing are provided in FIG. 5 and associated text.

Some embodiments of the method 400 may also limit measured bit depth limited to no more than measured hole depth, and correct bit depth for measured rig heave.

In block 414, the pre-processed sensor measurements and additional values generated by the pre-processing module 212 are provided to the rig state model 216 for use in producing a rig state value.

Figure 5:
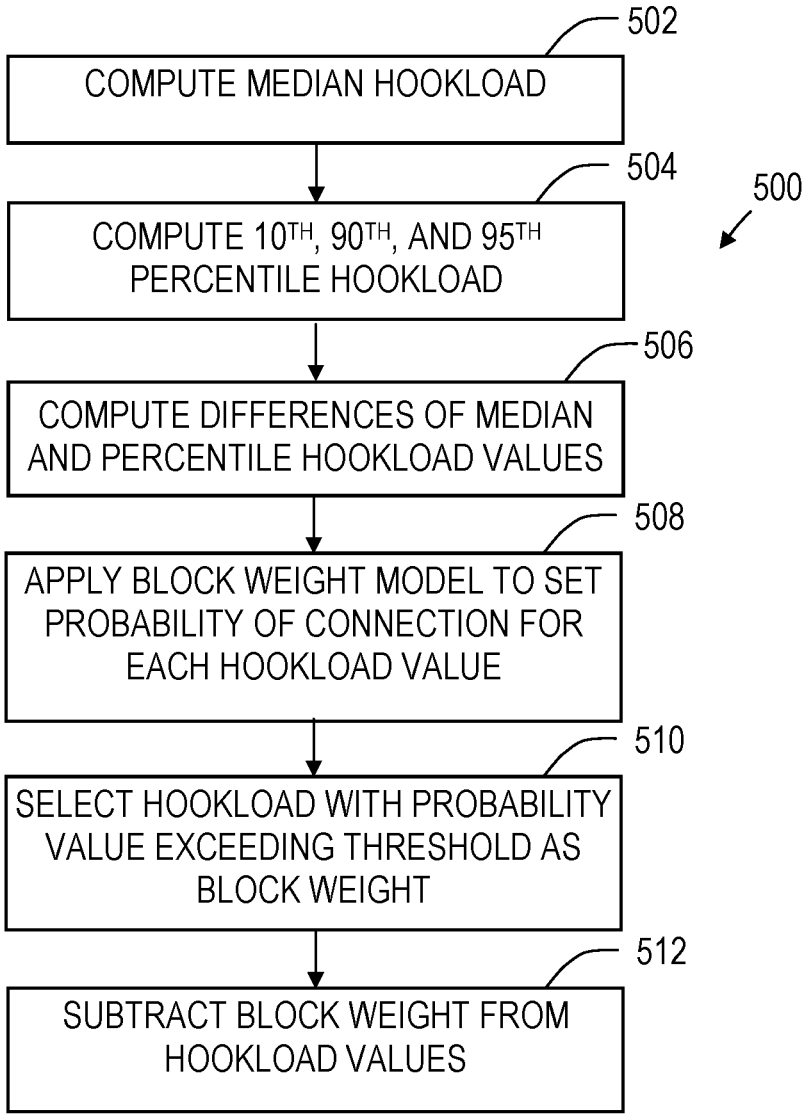
FIG. 5 shows a flow diagram for a method for rebasing hookload values for determining rig state in accordance with principles disclosed herein.

FIG. 5 shows a flow diagram for a method 500 for rebasing hookload values for determining rig state in accordance with principles disclosed herein. Though depicted sequentially as a matter of convenience, at least some of the actions shown can be performed in a different order or performed in parallel. Additionally, some embodiments may perform only some of the actions shown. In some embodiments, at least some of the operations of the method 500, as well as other operations described herein, can be implemented by the drilling control system 128 via execution of instructions of the rig state monitoring module 210 by the processor 202. Operations of the method 500 may be performed as part of the operations of block 412 of FIG. 4.

In block 502, the hookload rebasing module 214 calculates a median hookload value for the hookload measurements centered at given hookload measurement. For example, the hookload rebasing module 214 may calculate a median hookload value over 31 sequential hookload measurements where the given hookload measurement is the $16^{th}$ measurement of the sequence (i.e., the given hookload value is at the center of the sequence. Some embodiments may compute the median hookload value over a different number of hookload measurements.

In block 504, the hookload rebasing module 214 calculates various hookload measurement percentile values for a sequence of hookload measurements. For example, given 31 sequential hookload measurement values, the hookload rebasing module 214 may calculate the $10^{th}$ and $95^{th}$ percentile hookload values. In some $90^{th}$ embodiments, the number of hookload measurements over which a percentile value is calculated may differ according to the specific percentile value. For example, 31 sequential hookload values may be used to produce the $10^{th}$ and $90^{th}$ percentile values, and 1000 sequential hookload values may be used to produce the $95^{th}$ percentile value.

In block 506, the hookload rebasing module 214 calculates various differences of the median and percentile hookload values calculated in blocks 502 and 504. For example, the hookload rebasing module 214 may calculate the difference of the median hookload value and each of the percentile values, and may calculate a difference of each two percentile values.

In block 508, the hookload rebasing module 214 applies the difference values calculated in block 506, the percentile values calculated in block 504, the median hookload value calculated in block 502, or other of the sensor measurements and additional input values calculated by the pre-preprocessing module 212 to a block weight model. The block weight model assigns a probability value to each hookload measurement. The probability value defines a likelihood that the hookload value was acquired during a connection (i.e., while the drill string was not connected to the traveling block.

Like the rig state model 216, the block weight model may include a RANDOM FOREST comprising a plurality of randomized classification trees. In the block weight model, the inputs (the difference values calculated in block 506, the percentile values calculated in block 504, the median hookload value calculated in block 502, or other of the sensor measurements and additional input values calculated by the pre-preprocessing module 212) are processed by each of the plurality of classification trees, and each tree classifies the inputs as indicating that the hookload measurement was acquired while the drill string 108 was detached from the traveling block. The probability value generated by the block weight model may be function of the percentage of total number of classification trees that identify the hookload value as being acquired during connection.

In block 510, the hookload rebasing module 214 compares the probability value generated by the block weight model to a predetermined threshold to determine whether the hookload value corresponding to the probability value is a block weight value. If the probability value exceeds (or is equal to) the threshold value, then the hookload rebasing module 214 selects the hookload measurement value as a block weight value. For example, if the probability value is 0.99 and the predetermined threshold is 0.98, then the hookload measurement value is selected for use a block weight value going forward (e.g., until a later processed hookload value is assigned a probability value that exceeds the threshold).

In block 512, a block weight value identified in block 510 is subtracted from each hookload measurement value starting with the hookload measurement value corresponding to the block weight value to produce rebased hookload values. In some embodiments, the block weight value identified in block 510 may be subtracted from hookload measurement values acquired prior to the hookload measurement value corresponding to the block weight value. For example, if the hookload measurement values prior the hookload measurement value corresponding to the block weight value have not been rebased, then block weight value will be subtracted from the previously acquired hookload measurement values to rebase the hookload measurement values.

Figure 6:
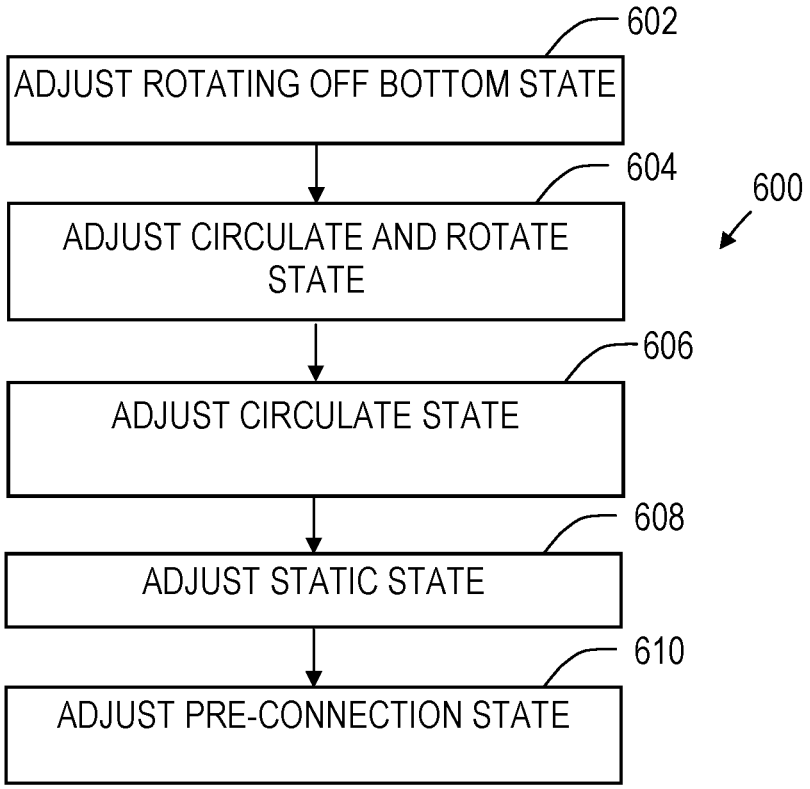
FIG. 6 shows a flow diagram for a method for post-processing rig state generated by a rig classification model in accordance with principles disclosed herein.

FIG. 6 shows a flow diagram for a method 600 for post-processing rig state generated by a rig classification model in accordance with principles disclosed herein. Though depicted sequentially as a matter of convenience, at least some of the actions shown can be performed in a different order or performed in parallel. Additionally, some embodiments may perform only some of the actions shown. In some embodiments, at least some of the operations of the method 600, as well as other operations described herein, can be implemented by the drilling control system 128 via execution of instructions of the rig state monitoring module 210 by the processor 202. Operations of the method 600 may be performed as part of the operations of block 308 of FIG. 3.

In the method 600, the post-processing module 218 has received a rig state value from the rig state model 216. The post-processing module 218 analyzes the rig state generated by the rig state model 216 in light of previously or subsequently generated rig state values stored in the rig state data 238 and various sensor measurements to determine whether a different rig state might be more appropriate. For example, the post-processing module 218 may correct a rig state value that is distorted by the periodic acquisition (sampling) of the sensor measurements.

In block 602, if the rig state value received from the rig state model 216 is "rotating off bottom," then the post-processing module 218 determines whether the "reaming down without flow" state or the "backreaming without flow" state may be more appropriate. For example, if the rig state value received from the rig state model 216 is "rotating off bottom," but the bit depth measurements at times about the time corresponding to the rig state determination indicate that drill bit depth is increasing, then the post-processing module 218 may change the rig state value to "reaming down with flow." If the rig state value received from the rig state model 216 is "rotating off bottom," but the bit depth measurements indicate that drill bit depth is decreasing, then the post-processing module 218 may change the rig state value to "backreaming without flow."

In block 604, if the rig state value received from the rig state model 216 is "circulating and rotating," then the post-processing module 218 determines whether the "reaming down with flow" state or the "backreaming with flow" state may be more appropriate. For example, if the rig state preceding "circulating and rotating" is either "reaming down with flow" or "backreaming with flow," and time spent in the "circulating and rotating" state is less than a predetermined amount (e.g., 20 seconds) then the post-processing module 218 may change the rig state value to the state preceding "circulating and rotating."

In block 606, if the rig state value received from the rig state model 216 is "circulating," then the post-processing module 218 determines whether the "washing up" state or the "washing down" state may be more appropriate. For example, if the rig state preceding "circulating" is either "washing up" or "washing down," and time spent in the "circulating" state is less than a predetermined amount (e.g., 20 seconds) then the post-processing module 218 may change the rig state value to the state preceding "circulating."

In block 608, if the rig state value received from the rig state model 216 is "static," then the post-processing module 218 determines whether the "trip in" state or the "trip out" state may be more appropriate. For example, if the rig state preceding "static" is either "trip in" or "trip out," and time spent in the "static" state is less than a predetermined amount (e.g., 20 seconds) then the post-processing module 218 may change the rig state value to the state preceding "static."

In block 610, post-processing module 218 analyzes rig states immediately prior to a change in state to "connection." For example, if the rig state prior to the change in state to "connection" is "rotary drilling" and the hole depth is not changing, then the post-processing module 218 may change the state to "circulating and rotating." If the rig state prior to the change in state to "connection" is "slide drilling" and the hole depth is not changing, then the post-processing module 218 may change the state to "circulating."

If the rig state changes to "connection," the post-processing module 218 may examine the rig states generated for a predetermined time prior to the change to "connection." If the post-processing module 218 finds another "connection" rig state preceding the change to "connection" and the bit depth between the two "connection" states has changed by less than a predetermined amount (e.g., less than 10 feet), then the post-processing module 218 may change all rig state values between the two "connection" states to "connection."

By detecting rig state as disclosed herein, the rig state monitor 144 is able to provide more accurate determinations of rig state than are provided by conventional rig state classification techniques. As a result, the drilling control system 128 is able to provide control of the drilling system 100 that improves drilling efficiency and reduces the overall cost of hydrocarbon production.

Various embodiments of systems and methods for controlling a drilling system based on rig state are disclosed herein. In an embodiment, a method for controlling drilling of subterranean formations includes receiving measured values indicative of operations performed by drilling equipment while drilling the formations. The measured values include hookload values, and the method includes adjusting each of the hookload values to remove block weight from the hookload value. The adjusting includes analyzing each of the hookload values to determine whether the hookload value was acquired while connecting a drill pipe to a drill string. The analyzing includes for each of the hookload values, assigning, to the hookload value, a probability that the hookload value was acquired while connecting a drill pipe to the drill string. The analyzing further includes setting each hookload value corresponding to a probability value exceeding a predetermined threshold to be a block weight value. The adjusting also includes subtracting the block weight value from each hookload value acquired after the block weight value and before a different block weight value is identified to produce rebased hookload values. The method also includes applying the measured values and the rebased hookload values corresponding to operation of the drilling equipment during a first predetermined time interval to a rig state model comprising a plurality of randomized decision trees. The method further includes producing a first value for a state of the drilling equipment during the first predetermined time interval as an output of the model based on the measured values and the rebased hookload values. The method yet further includes changing an operation performed to drill the subterranean formations responsive to the first value for the state of the drilling equipment.

In an embodiment of the method, changing the operation includes reducing a time duration during which the operation is performed. The operation may include actions performed to connect a drill pipe to a drill string used to drill the subterranean formations.

An embodiment of the method may include determining whether the first value for the state of the drilling equipment during the first predetermined time interval is distorted by the periodic acquisition (sampling) of the measured values. Based on a determination that the first value is distorted by sampling, the method may include producing a second value for the state of the drilling equipment during the first predetermined time interval. The second value may be based on at least one of a state of the drilling equipment prior to the predetermined time interval and a state of the drilling equipment subsequent to the predetermined time interval. In some embodiments of the method, producing the second value for the state includes changing the first value for the state, wherein the first value indicates that a drill string is stationary, to the second value for the state, wherein the second value indicates that the drill string is moving longitudinally. In some embodiments of the method, the first value for the state is circulate and the second value for the state is one of wash up and wash down; or the first value for the state is circulate and rotate and the second value for the state is one of reaming and backreaming; or the first value for the state is rotating and the second value for the state is one of backreaming without flow and reaming without flow; or the first value for the state is static and the second value for the state is one of trip in and trip out.

In some embodiments of the method, the measured values comprise weight on bit, standpipe pressure, surface torque, surface rotation speed, rate of penetration, rate of drilling fluid flow, hookload, measured hole depth, and measured bit depth. The method may also include processing the measured values to generate additional values including one or more of: a moving average of hole depth; a moving average of bit depth; measured bit depth limited to no more than measured hole depth; difference of measured hole depth and measured bit depth; bit depth corrected for rig heave; values of change in difference of measured hole depth and measured bit depth over time; drilling fluid flow quantified to a binary value; and rotation speed quantified to a binary value. The method may also include applying the additional values to the rig state model to produce the first value for the state.

Some embodiments of the method may also include identifying initiation of connection of a drill pipe to a drill string, and identifying a state of the drilling equipment occurring prior to the initiation of the connection in which the hole depth is not changing and a state of the drilling equipment is set to slide drilling or rotary drilling. The method may change a value of the state of the drilling equipment occurring prior to the initiation of the connection to be one of circulating and circulating and rotating.

Some embodiment of the method may also include identifying a change in state of the drilling equipment to connection from a different state; and changing a value of state of the drilling equipment at a time prior to the first change to connecting based on difference in bit depth between the first change in state and the bit depth for the value of state of the drilling equipment at a time prior to the first change being less than a predetermined amount.

Some embodiment of the method may also include identifying a change in state of the drilling equipment to rotate off bottom state from a different state; and altering a value of state of the drilling equipment at the time of the change in state to one of reaming without flow and backreaming without flow.

Some embodiment of the method may also include identifying a connection state based on hookload indicating a connection state, wherein hookload indicates the connection state based on hookload being less than a predetermined percentage of a range of the hookload over a predetermined interval. The method may also include setting a state of the drilling equipment to connection based on a current value of the state of the drilling equipment being a stationary state and hookload indicating the connection state.

In some embodiments of the method the first value for the state of the drilling equipment identifies the drilling equipment as being in a drilling state comprising rotary drilling or slide drilling, and embodiments of the method may include: comparing parameters applied by the drilling equipment to drill the subterranean formations to a range specified for each of the parameters; and changing a value of a given one of the parameters to be within the range specified for the given one of the parameters.

In some embodiments of the method, the analyzing includes, for each of the hookload values: computing a median hookload value centered at the hookload value; computing a plurality of percentile values centered at the hookload value; and computing a difference of each combination of the median hookload value and the percentile values. The assigning may include applying the difference values to a block weight model comprising a plurality of randomized decision trees.

In an embodiment, a system for drilling subterranean formations includes drilling equipment and a monitor. The drilling equipment includes a drill string, a rig, sensors, and a drilling control system. The drill string is to extend a borehole in the subterranean formations. The rig is to support the drill string. The sensors are to measure values indicative of operation of the drilling equipment while drilling the formations. The drilling control system is to control extension of the drill string. The monitor is to determine a state of the drilling equipment while drilling the subterranean formations. The monitor is configured to: 1) receive measured values indicative of operation of the drilling equipment measured by the sensors, wherein the measured values include hookload values; 2) adjust each of the hookload values to remove block weight from the hookload value by: analyzing each of the hookload values to determine whether the hookload value was acquired while connecting a drill pipe to a drill string, and subtracting the block weight value from each hookload value acquired after the block weight value and before a different block weight value is identified to produce rebased hookload values. The analyzing includes: for each of the hookload values, assigning, to the hookload value, a probability that the hookload value was acquired while connecting a drill pipe to the drill string; and setting each hookload value corresponding to a probability value exceeding a predetermined threshold to be a block weight value. The monitor is further configured to: 3) apply the measured values and the rebased hookload values corresponding to operation of the drilling equipment during a first predetermined time interval to a rig state model comprising a plurality of randomized decision trees; and 4) produce a first value for a state of the drilling equipment during the first predetermined time interval as an output of the model based on the measured values and the rebased hookload values. The drilling control system is configured to change an operation performed to drill the subterranean formations responsive to the first value of the state of the drilling equipment.

In some embodiments of the system, the monitor is configured to determine whether the first value for the state of the drilling equipment during the first predetermined time interval is distorted by the periodic acquisition (sampling) of the measured values, and based on a determination that the first value is distorted by the periodic acquisition: produce a second value for the state of the drilling equipment during the first predetermined time interval. The second value based on at least one of a state of the drilling equipment prior to the predetermined time interval and a state of the drilling equipment subsequent to the predetermined time interval. The monitor is coupled to the drilling control system, and the monitor may be configured to provide the second state value to the drilling control system; and the drilling control system is configured to change an operation performed by the drilling equipment to drill the subterranean formations responsive to the second value for the state of the drilling equipment. The drilling control system may be configured to change the operation by reducing a time duration during which the operation is performed. The operation may include actions performed to connect a drill pipe to a drill string used to drill the subterranean formations. The monitor may be configured to produce the second value for the state by changing the first value for the state to the second value for the state, wherein the first value indicates that a drill string is stationary, and the second value indicates that the drill string is moving longitudinally. The first value for the state may be circulating and the second value for the state may be one of washing up and washing down; or the first value for the state may be circulating and rotating and the second value for the state may be one of reaming and backreaming; or the first value for the state may be rotating and the second value for the state may be one of backreaming without flow and reaming without flow; or the first value for the state may be static and the second value for the state may be one of trip in and trip out.

In some embodiments of the system, the measured values include weight on bit, standpipe pressure, surface torque, surface rotation speed, rate of penetration, rate of drilling fluid flow, hookload, measured hole depth, or measured bit depth. The monitor may be configured to process the measured values to generate additional values, and apply the additional values to the rig state model to produce the first value for the state. The additional values may include one or more of: a moving average of hole depth; a moving average of bit depth; measured bit depth limited to no more than measured hole depth; difference of measured hole depth and measured bit depth; bit depth corrected for rig heave; values of change in difference of measured hole depth and measured bit depth over time; drilling fluid flow quantified to a binary value; and rotation speed quantified to a binary value.

In some embodiments of the system, the monitor is configured to: 1) identify initiation of connection of a drill pipe to a drill string; 2) identify a state of the drilling equipment occurring prior to the initiation of the connection in which the hole depth is not changing and a state of the drilling equipment is set to slide drilling or rotary drilling; and 3) change a value of the state of the drilling equipment occurring prior to the initiation of the connection to be one of: circulating, and circulating and rotating.

In some embodiments of the system, the monitor is configured to: 1) identify a change in state of the drilling equipment to connection from a different state; and 2) change a value of state of the drilling equipment at a time prior to the first change to connecting based on difference in bit depth between the first change in state and the bit depth for the value of state of the drilling equipment at a time prior to the first change being less than a predetermined amount.

In some embodiments of the system, the monitor is configured to: 1) identify a change in state of the drilling equipment to rotate off bottom state from a different state; and 2) alter a value of state of the drilling equipment at the time of the change in state to one of reaming without flow and backreaming without flow.

In some embodiments of the system, the monitor is configured to: 1) identify a connection state based on hookload indicating a connection state, wherein hookload indicates the connection state based on hookload being less than a predetermined percentage of a range of the hookload over a predetermined interval; and 2) set a state of the drilling equipment to connection based on a current value of the state of the drilling equipment being a stationary state and hookload indicating the connection state.

In some embodiments of the system, wherein the first value for the state of the drilling equipment identifies the drilling equipment as being in a drilling state including rotary drilling or slide drilling, and the drilling control system is configured to: 1) compare parameters applied by the drilling equipment to drill the subterranean formations to a range specified for each of the parameters; and 2) change a value of a given one of the parameters to be within the range specified for the given one of the parameters.

In some embodiments of the system, the monitor is configured to, for each of the hookload values: 1) compute a median hookload value centered at the hookload value; 2) compute a plurality of percentile values centered at the hookload value; 3) compute a difference of each combination of the median hookload value and the percentile values; and 4) apply the difference values to a block weight model comprising a plurality of randomized decision trees.

In an embodiment, a non-transitory computer-readable medium is encoded with instructions that when executed cause a processor to: 1) receive measured values indicative of operations performed by drilling equipment while drilling the formations, wherein the measured values include hookload values; 2) process the measured values to generate additional values indicative of operations performed by the drilling equipment while drilling the formations; 3) adjust each of the hookload values to remove block weight from the hookload value to produce rebased hookload values; 4) apply the measured values and the rebased hookload values corresponding to operation of the drilling equipment during a first predetermined time interval to a rig state model comprising a plurality of randomized decision trees; 5) produce a value for a state of the drilling equipment during the first predetermined time interval as an output of the rig state model based on the measured values and the rebased hookload values; and 6) change an operation performed to drill the subterranean formations responsive to the state of the drilling equipment. The adjusting each of the hookload values includes analyzing each of the hookload values to determine whether the hookload value was acquired while connecting a drill pipe to a drill string. The analyzing each of the hookload values includes: 1) computing a median hookload value centered at the hookload value; 2) computing a plurality of percentile values centered at the hookload value; 3) computing a difference of each combination of the median hookload value and the percentile values; 4) applying the difference values to a block weight model comprising a plurality of randomized decision trees to assign to each of the hookload values a probability that the hookload value was acquired while connecting a drill pipe to the drill string; 5) setting each hookload value corresponding to a probability value exceeding a predetermined threshold to be a block weight value; and 6) subtracting the block weight value from each hookload value acquired after the block weight value and before a different block weight value is identified to produce rebased hookload values.

In the drawings and description of the present disclosure, like parts are typically marked throughout the specification and drawings with the same reference numerals. The drawing figures are not necessarily to scale. Certain features of the invention may be shown exaggerated in scale or in somewhat schematic form, and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings and components of the embodiments discussed below may be employed separately or in any suitable combination to produce desired results.

The above discussion is meant to be illustrative of various principles and embodiments of the present disclosure. While certain embodiments have been shown and described, modifications thereof can be made by one skilled in the art without departing from the spirit and teachings of the disclosure. The embodiments described herein are exemplary only, and are not limiting. Accordingly, the scope of protection is not limited by the description set out above, but is only limited by the claims which follow, that scope including all equivalents of the subject matter of the claims.

What is claimed is:

1. A method for controlling drilling of subterranean formations, comprising:

receiving measured values indicative of operations performed by drilling equipment while drilling the formations, wherein the measured values include hookload values;

adjusting each of the hookload values to remove block weight from the hookload value, the adjusting comprising:

analyzing each of the hookload values to determine whether the hookload value was acquired while connecting a drill pipe to a drill string, the analyzing comprising:

for each of the hookload values, assigning, to the hookload value, a probability that the hookload value was acquired while connecting a drill pipe to the drill string;

setting each hookload value corresponding to a probability value exceeding a predetermined threshold to be a block weight value;

subtracting the block weight value from each hookload value acquired after the block weight value and before a different block weight value is identified to produce rebased hookload values;

applying the measured values and the rebased hookload values corresponding to operation of the drilling equipment during a first predetermined time interval to a rig state model comprising a plurality of randomized decision trees;

producing a first value for a state of the drilling equipment during the first predetermined time interval as an output of the model based on the measured values and the rebased hookload values;

changing an operation performed to drill the subterranean formations responsive to the first value for the state of the drilling equipment.

2. The method of claim 1, wherein changing the operation comprises reducing a time duration during which the operation is performed.

3. The method of claim 1, wherein the operation comprises actions performed to connect a drill pipe to a drill string used to drill the subterranean formations.

4. The method of claim 1, further comprising:

determining whether the first value for the state of the drilling equipment during the first predetermined time interval is distorted by sampling of the measured values;

based on a determination that the first value is distorted by sampling:

producing a second value for the state of the drilling equipment during the first predetermined time interval, the second value based on at least one of a state of the drilling equipment prior to the predetermined time interval and a state of the drilling equipment subsequent to the predetermined time interval.

5. The method of claim 4, wherein producing the second value for the state comprises changing the first value for the state, wherein the first value indicates that a drill string is stationary, to the second value for the state, wherein the second value indicates that the drill string is moving longitudinally.

6. The method of claim 4, wherein the first value for the state is circulate and the second value for the state is one of wash up and wash down; or the first value for the state is circulate and rotate and the second value for the state is one of ream and backreaming; or the first value for the state is rotate and the second value for the state is one of backreaming without flow and reaming without flow; or the first value for the state is static and the second value for the state is one of trip in and trip out.

7. The method of claim 1:

wherein the measured values comprise weight on bit, standpipe pressure, surface torque, surface rotation speed, rate of penetration, rate of drilling fluid flow, hookload, measured hole depth, and measured bit depth; and the method further comprising:

processing the measured values to generate additional values comprising one or more of:
a moving average of hole depth;
a moving average of bit depth;
measured bit depth limited to no more than measured hole depth;
difference of measured hole depth and measured bit depth;
bit depth corrected for rig heave;
values of change in difference of measured hole depth and measured bit depth over time;
drilling fluid flow quantified to a binary value; and
rotation speed quantified to a binary value; and
applying the additional values to the rig state model to produce the first value for the state.

8. The method of claim 1, further comprising:
identifying initiation of connection of a drill pipe to a drill string;
identifying a state of the drilling equipment occurring prior to the initiation of the connection in which the hole depth is not changing and a state of the drilling equipment is set to slide drilling or rotary drilling;
changing a value of the state of the drilling equipment occurring prior to the initiation of the connection to be one of:
circulating; and
circulating and rotating.

9. The method of claim 1, further comprising:
identifying a change in state of the drilling equipment to connection from a different state; and
changing a value of state of the drilling equipment at a time prior to the first change to connecting based on difference in bit depth between the first change in state and the bit depth for the value of state of the drilling equipment at a time prior to the first change being less than a predetermined amount.

10. The method of claim 1, further comprising:
identifying a change in state of the drilling equipment to rotate off bottom state from a different state; and
altering a value of state of the drilling equipment at the time of the change in state to one of ream without flow and backreaming without flow.

11. The method of claim 1, further comprising identifying a connection state based on hookload indicating a connection state, wherein hookload indicates the connection state based on hookload being less than a predetermined percentage of a range of the hookload over a predetermined interval.

12. The method of claim 11, further comprising setting a state of the drilling equipment to connection based on a current value of the state of the drilling equipment being a stationary state and hookload indicating the connection state.

13. The method of claim 1:
wherein the first value for the state of the drilling equipment identifies the drilling equipment as being in a drilling state comprising rotary drilling or slide drilling;
further comprising:
comparing parameters applied by the drilling equipment to drill the subterranean formations to a range specified for each of the parameters; and
changing a value of a given one of the parameters to be within the range specified for the given one of the parameters.

14. The method of claim 1:
wherein the analyzing comprises:
for each of the hookload values:
computing a median hookload value centered at the hookload value;
computing a plurality of percentile values centered at the hookload value; and
computing a difference of each combination of the median hookload value and the percentile values; and
wherein the assigning comprises:
applying the difference values to a block weight model comprising a plurality of randomized decision trees.

* * * * *